US007954273B1

(12) United States Patent
Swan

(10) Patent No.: US 7,954,273 B1
(45) Date of Patent: Jun. 7, 2011

(54) WEAPON LIGHT

(76) Inventor: Richard E. Swan, E. Bridgewater, MA (US)

( * ) Notice: Subject to any disclaimer, the term of this patent is extended or adjusted under 35 U.S.C. 154(b) by 0 days.

(21) Appl. No.: 12/687,409

(22) Filed: Jan. 14, 2010

Related U.S. Application Data

(60) Provisional application No. 61/144,473, filed on Jan. 14, 2009.

(51) Int. Cl.
*F41G 1/35* (2006.01)

(52) U.S. Cl. ..... 42/115; 42/117; 42/146; 362/110

(58) Field of Classification Search ..... 42/114, 42/115, 116, 117, 142, 146; 362/110, 113, 362/114
See application file for complete search history.

(56) References Cited

U.S. PATENT DOCUMENTS

| | | | | |
|---|---|---|---|---|
| 1,644,125 | A | 10/1927 | Harris | |
| D191,991 | S | 12/1961 | Bessier | |
| 3,030,497 | A | 4/1962 | Cheng | |
| 4,571,870 | A * | 2/1986 | Heideman et al. | 42/1.01 |
| D365,621 | S | 12/1995 | Coste | |
| 5,704,155 | A * | 1/1998 | Primeau, IV | 42/114 |
| 5,758,448 | A * | 6/1998 | Thummel | 42/114 |
| D396,313 | S | 7/1998 | Dalton et al. | |
| 6,345,464 | B1 * | 2/2002 | Kim et al. | 42/114 |
| D455,510 | S | 4/2002 | Galli | |
| D455,513 | S | 4/2002 | Galli | |
| D501,943 | S | 2/2005 | Lui (Phillip) | |
| D569,537 | S | 5/2008 | Lui (Phillip) | |
| D570,018 | S | 5/2008 | Ciccone, Jr. et al. | |
| D574,982 | S | 8/2008 | Lau | |
| D579,135 | S | 10/2008 | Shiu | |
| D582,592 | S | 12/2008 | Opolka | |
| D585,516 | S | 1/2009 | Smith | |
| 2002/0097576 | A1 | 7/2002 | Sharrah et al. | |
| 2004/0120142 | A1 | 6/2004 | Galli | |

* cited by examiner

*Primary Examiner* — Stephen M Johnson
(74) *Attorney, Agent, or Firm* — Barlow, Josephs & Holmes, Ltd.

(57) ABSTRACT

A mounting platform that includes an annular housing which is received around the barrel of the firearm is configured to include interchangeable electronics modules, such as visible lights, infrared emitters, laser sighting devices, range finders, video cameras, tasers, etc. The accessory mounting platform includes a central aperture for receiving the barrel of the weapon therethrough. The front of the housing includes a faceplate that has a plurality of sockets therein for receiving a plurality of electronic accessory modules. Each of the modules is individually threaded and can be selectively mounted into any of the threaded mounting sockets. Each of the accessory modules is fully interchangeable and can be removed if not needed. The accessory mounting platform is preferably mounted to the bayonet lug and front sight of the weapon.

10 Claims, 12 Drawing Sheets

WEAPON LIGHT

CROSS-REFERENCE TO RELATED APPLICATIONS

This application is related to and claims priority from earlier filed U.S. Provisional Patent Application No. 61/144,473, filed Jan. 14, 2009.

BACKGROUND OF THE INVENTION

The present invention relates generally to lighting devices for use in connection with firearms and assault weapons. More specifically, the present invention relates to a lighting device that has an annular body with an opening therein such that the lighting device, when installed onto a firearm, surrounds the barrel of the weapon.

In the general field of combat and commercial weaponry, numerous add-on enhancements have become available for attachment to standard firearms thereby significantly upgrading the capability of the firearm. One area within the broad scope of available firearms that is of particular interest is the M16/M4 weapon system typically utilized in military or combat settings. Generally, the M16/M4 weapon as depicted at FIG. 1 includes a lower receiver 4, an upper receiver 6, a butt stock 8 extending rearwardly from the upper and lower receivers and a barrel 10 that is attached to the front of the upper receiver 6 and extends in a forward direction and a front sight 12 attached to the forward end of the barrel 10 with a bayonet lug 14 that extends from the bottom thereof. The barrel 10 is held in position on the front of the upper receiver 6 by a barrel nut that is threaded onto a barrel mount located on the front of the upper receiver. Most new models of the M16/M4 weapons also include a dovetail rail interface 16 integrally formed along the top of the upper receiver. This interface rail 16 provides a convenient mounting point for many of the available accessories for use with the M16/M4 firearm such as scopes, sighting devices, lasers and directed fire devices. Since this rail extends only along the upper receiver the interface is limited in length to the length of the receiver. The difficulty is that many military personnel have multiple sighting devices in addition to a variety of lighting devices, accessory handgrips, etc. that could also be attached to the weapon for enhanced use of the weapon. In view of the broad range of add on accessories, there is not enough space on the upper receiver to accommodate all of the accessories that the user may desire to use.

In an attempt to overcome the space limitations, various methods and means have been developed for interfacing add-on enhancements to firearms. For example, U.S. Pat. No. 4,845,871 discloses a quickly detachable interface means for modular enhancements. Similarly, U.S. Pat. No. 5,142,806 discloses a universal receiver sleeve having an upper interface portion with standard, universal dimensions regardless of the firearm and having a lower interface portion specific to a particular firearm. Another interface means is disclosed in U.S. Pat. No. 5,343,650 where an extended rigid interface frame with upper and lower rails is shown that is joined to a firearm receiver and extends forward about the firearm's barrel to a head assembly replacing the firearm's normal front sight. A weaver type interface return portion is provided below the barrel from the head assembly to the receiver. A yoke braces the extended rigid frame receiver sleeve to the forward portion of the firearm's receiver. The distal end of the extended rigid frame receiver sleeve terminates in a front sight housing, which connects the upper and lower rails and provides a housing for advanced laser and sensor components, and the standard front sight bead. The front sight housing is self-supported by the connection of the upper and lower rails running back to the yoke and secured to the top of the receiver. The barrel of the rifle is free floating in that it does not touch the extended rigid frame receiver sleeve in any manner. This permits greater shooting accuracy and protects sensitive electrical components within the front sight housing by isolating the front sight housing from the heat generated from the barrel.

One of the difficulties with the prior art mounting systems is that they still do not provide enough room along the upper rail to allow multiple accessories to be used in conjunction with one another. Despite the space limitation, there is a broad spectrum of available accessories relating to optics for sighting targets. Further, there are many different types of optics for the many different and varied types of combat that a soldier may face. For example, there are high power optics for snipers and there are low power red dot optics for close combat. There are also combination optics, such as the Trijicon® ACOG® optic, which includes an optic with a smaller degree of magnification (1×-4×) in combination with a red dot reticle. In any event, each of these optics must be mounted to the dovetail rail using some type of mount.

Another category of accessories employed in conjunction with firearms includes lights and lasers. These types of accessories are typically mounted on the hand guards of the weapon on the sides or on the top of the hand guard toward the front sight. Often, since one of the accessories used on the upper rail is an optical sight, most other accessories end up blocking the sight when mounted on the upper rail. Further, each of these additional accessories also takes up valuable space on the available dovetail rails and limits the overall number of possible accessories that can be mounted thereto. As a result, soldiers often have to make choices about which types of accessories they will mount for particular missions because all of the desired accessories will simply not fit onto the available rail space on the weapon.

Accordingly, there is a need in the industry for an alternate mounting platform that integrates several different accessories into a single alternate location in a manner that reduces the amount of space required for mounting them onto the weapon.

BRIEF SUMMARY OF THE INVENTION

In this regard, the present invention provides a unique mounting platform that includes an annular housing which is received around the barrel of the firearm and is configured to include interchangeable electronics modules, such as visible lights, infrared emitters, laser sighting devices, range finders, video cameras, tasers, etc. In this regard, the present invention provides a unique firearm accessory module that integrates and consolidates several different electronic elements at forward location thereby reducing the rail space required for mounting the devices individually.

The accessory mounting platform of the present invention includes a central aperture that extends therethrough. The central aperture is configured and arranged for receiving the barrel of the weapon therethrough. The front of the housing portion is provided with a faceplate that includes a plurality of openings or sockets therein for receiving a plurality of electronic accessory modules. Each of the modules is individually threaded and can be selectively mounted into any of the threaded mounting sockets.

Modules may include a plurality of electronic accessories that would normally be mounted onto the weapon as separate components. The accessory modules may include visible or infrared lighting devices such as a flashlight, a light emitting diode (LED) flashlight. These light elements can be configured to emit visible white light, colored light and/or infrared. Further, the light may be configured to operate in any number of modes including but not limited to continuous on, momentary on, high power, low power, strobe, etc. Further, the optical accessory module may include laser devices positioned therein such as a red dot laser sight commonly deployed on many weapons, an infrared laser for night vision targeting, a range finder device, a taser and/or a compact video camera depending on the needs of the combat mission. Each of the accessory modules is fully interchangeable and in the event that some electronics modules are not needed, the module can be removed and the open sockets can be closed with threaded plugs.

The accessory mounting platform is preferably mounted to the bayonet lug of the weapon and more preferably to the bayonet lug and the front upright leg of the front weapon sight. The rear of the housing includes a channel that wraps around the outside surfaces of the front sight. The lower portion of the rear wall of the channel is provided with a bayonet lug clamp, while the top portion of the rear wall is provided with a steel spring clip.

It is therefore an object of the present invention to provide an accessory mounting platform that provides for the integration of several different accessories into a single forward position about the barrel of the firearm in a manner that reduces the amount of space required for mounting them onto the weapon. It is a further object of the present invention to provide an accessory mounting platform that provides of the integration of several different accessories into a device that is affixed to the bayonet lug and/or front sight of a firearm at a location that surrounds the forward portion of the firearm barrel such that the entire assembly reduces the amount of space required for mounting the accessory modules onto the weapon.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
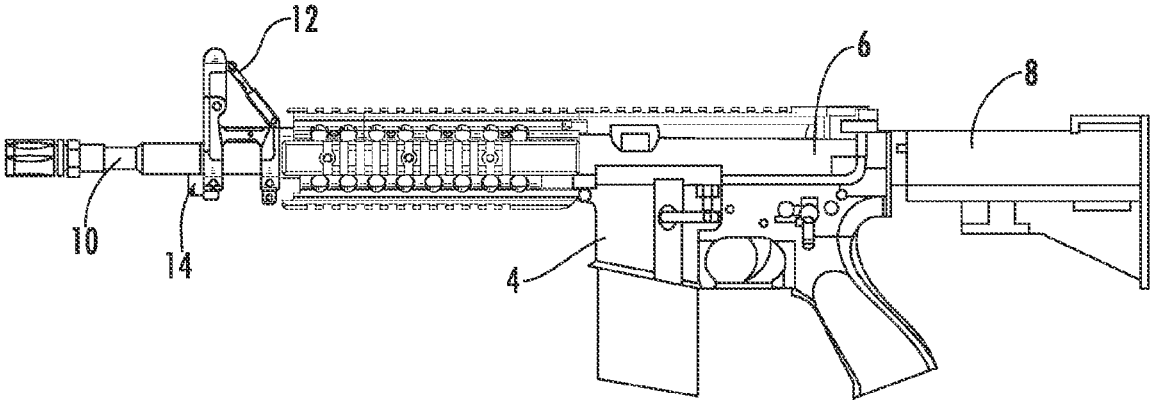
FIG. 1 PRIOR ART
FIG. 1 is a side view of a prior art M4.
Figure 2:
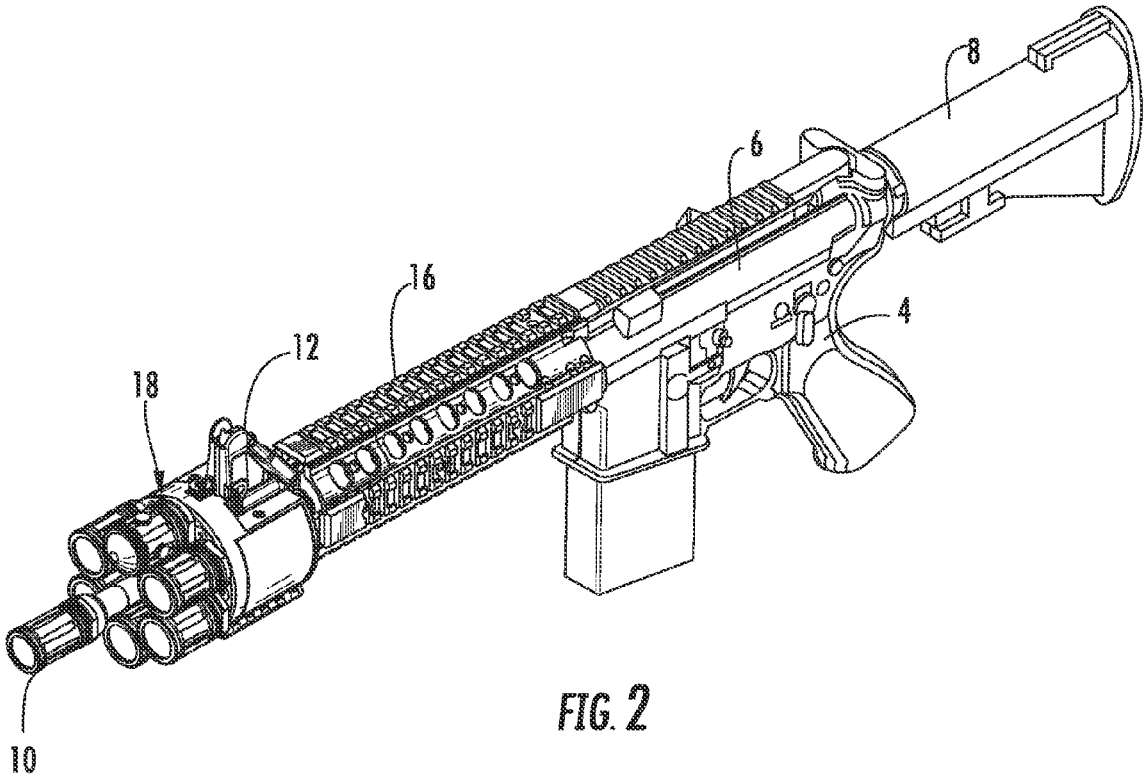
FIG. 2 is a perspective view of the accessory mounting platform of the present invention mounted on a firearm.

Now referring to the drawings, the accessory mounting platform is shown and generally illustrated at 18 in the figures. As can be seen, the mounting platform 18 generally includes an annular housing which is received around the barrel 10 of the firearm and is configured to include interchangeable electronics modules, as will be described in detail below. Such electronics modules may include visible lights, infrared emitters, laser sighting devices, range finders, video cameras, tasers, etc. In this regard, the present invention provides a unique firearm accessory module that integrates and consolidates several different electronic elements at forward location thereby reducing the rail space required for mounting the devices individually.

Figure 3:
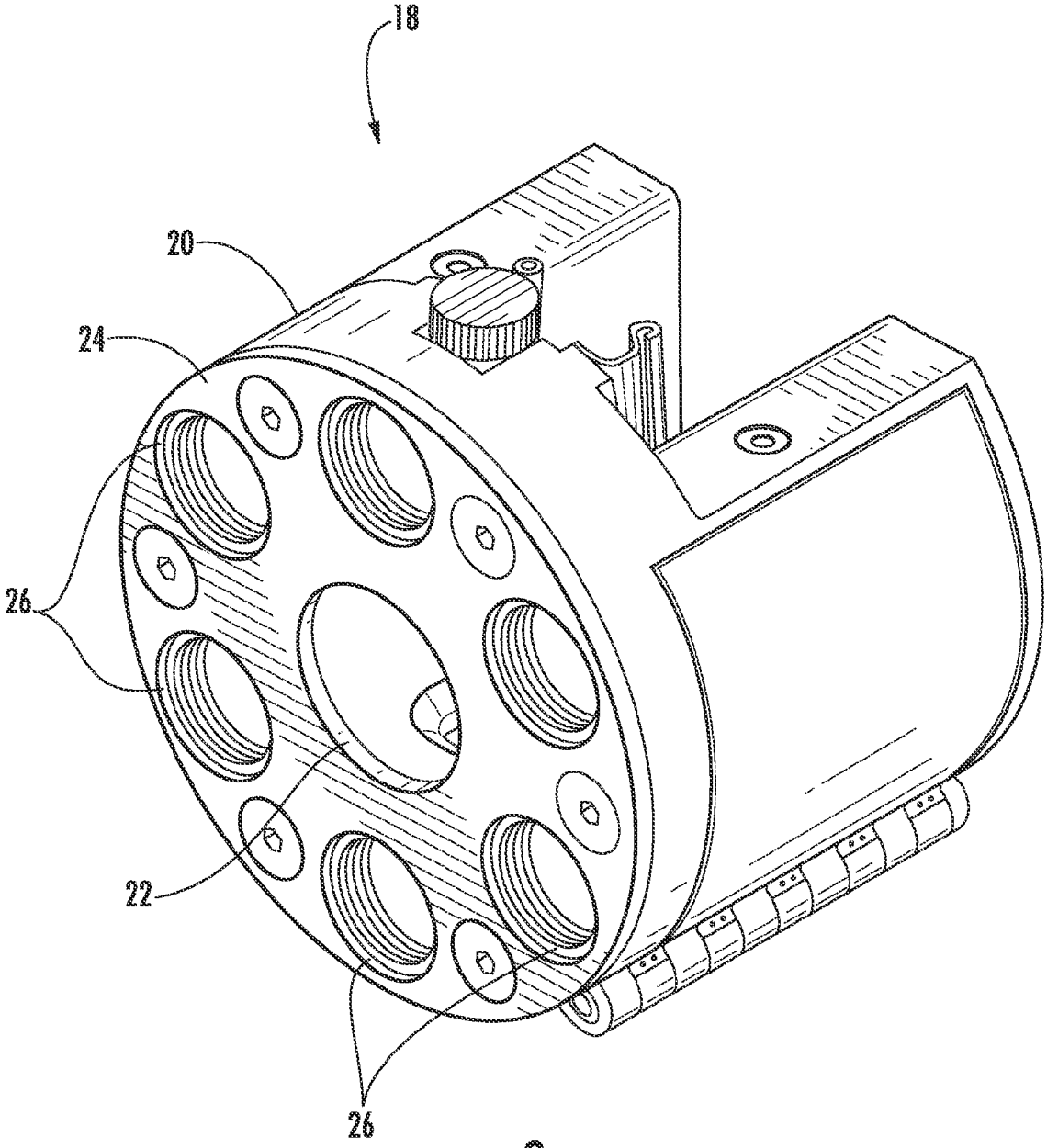
FIG. 3 is a front perspective view of the accessory mounting platform of the present invention with all of the accessory modules removed.

Turning now to FIG. 3, the accessory mounting platform 18 of the present invention generally includes an annular housing 20 with a central aperture 22 that extends therethrough. The central aperture 22 is configured and arranged for receiving the barrel 10 of the weapon therethrough when the accessory mounting platform 18 is received in assembled relation with the firearm. The front of the housing 20 portion is provided with a faceplate 24 that includes a plurality of openings or sockets 26 therein for receiving a plurality of electronic accessory modules as will be described in more detail below. It can be seen that the sockets 26 are threaded in a manner that allows them to each selectively receive one of the individually threaded modules. It should be noted that while female threaded sockets are depicted, male threaded sockets or nipples as well as male or female plug mounts are also intended to fall within the scope of the present invention.

Figure 4:
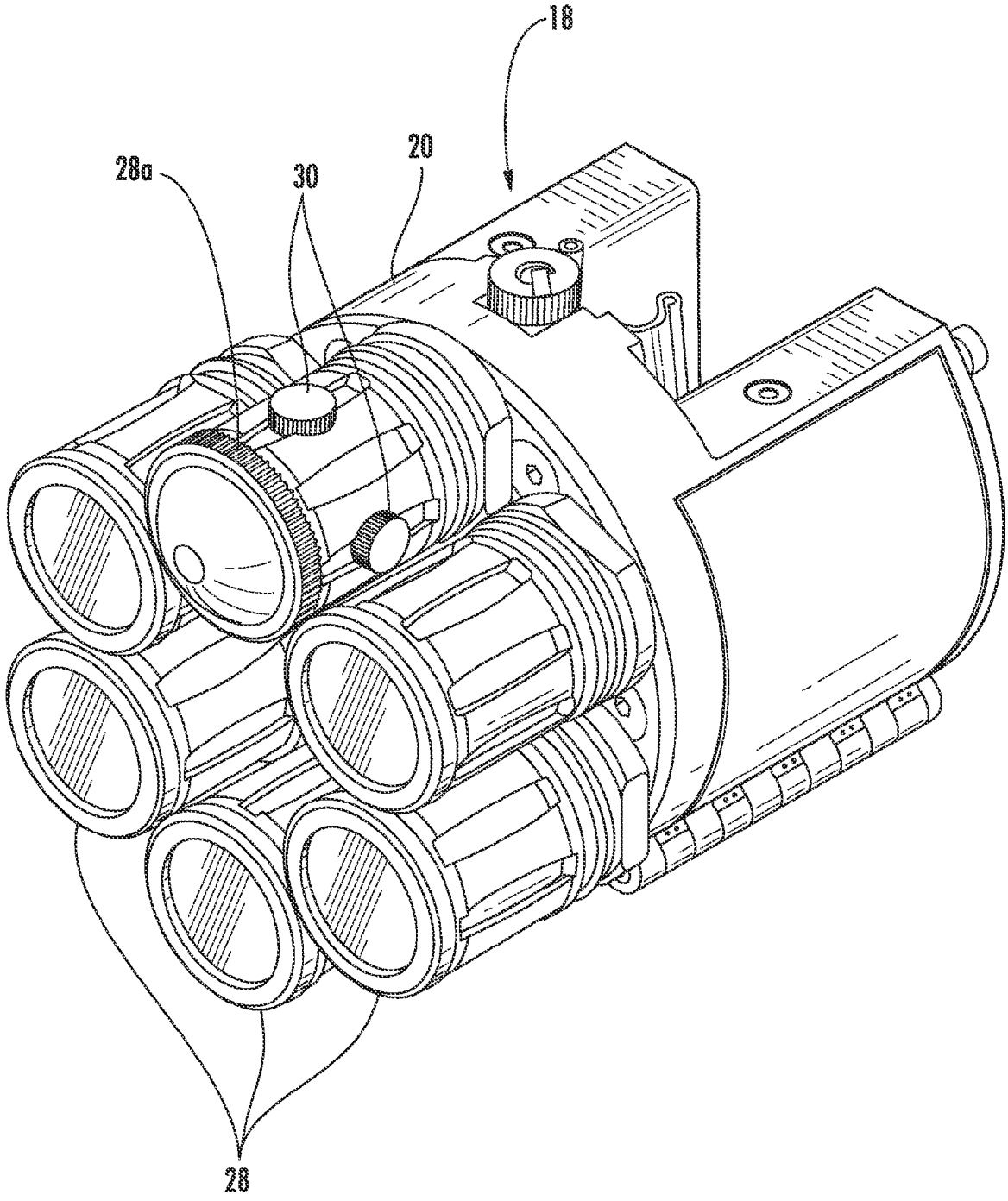
FIG. 4 is a front perspective view of the accessory mounting platform of the present invention with a plurality of accessory modules installed therein.
Figure 5:
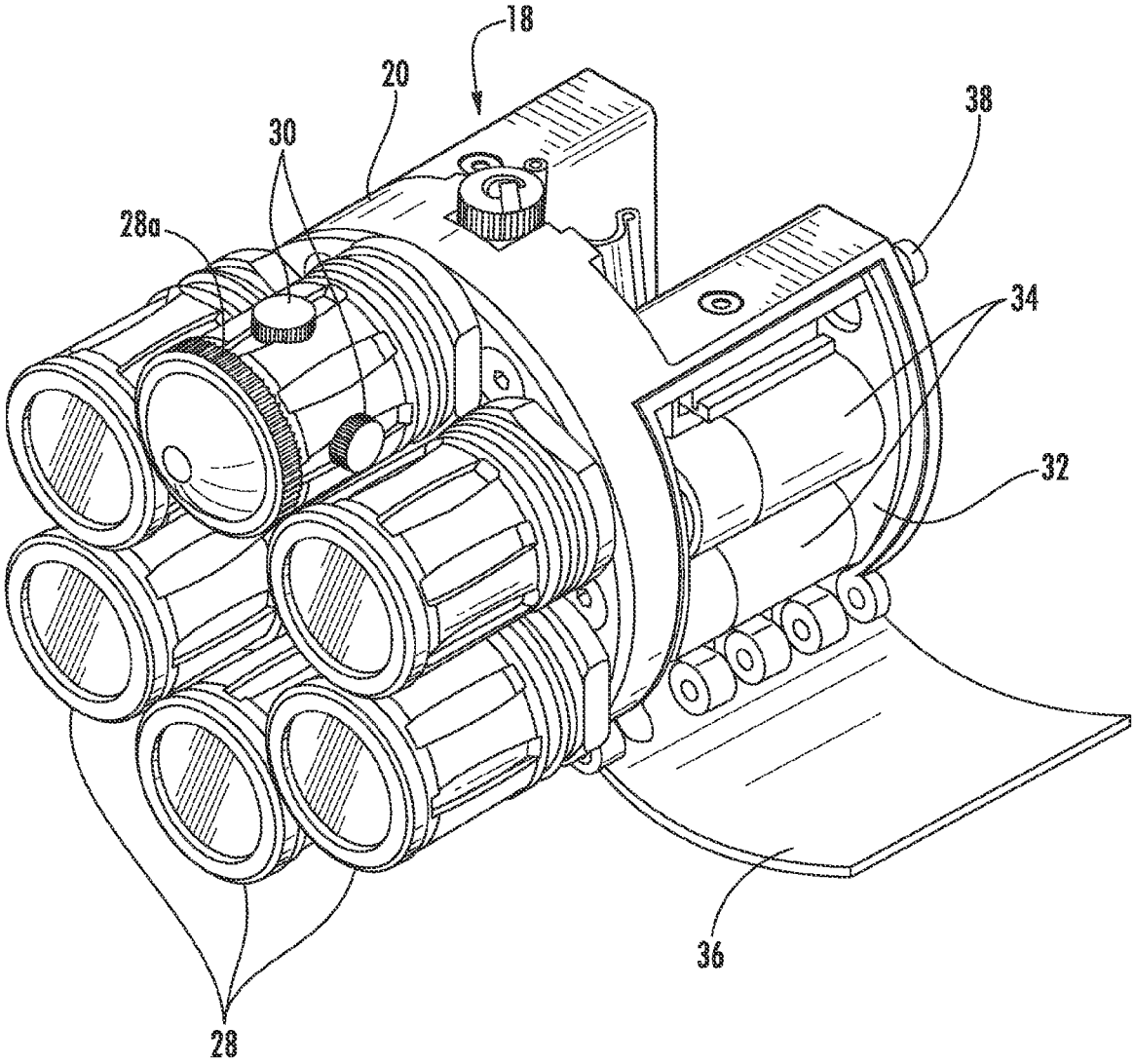
FIG. 5 is a front perspective view of the accessory mounting platform of the present invention with the battery compartment open.

As can best be seen in FIGS. 4 and 5, each of the modules 28 is individually threaded and can be selectively mounted into any of the threaded mounting sockets 26. Further, since all of the modules 28 are modular and interchangeable with one another, they can be reconfigured or repositioned in any manner desired by the user. For example, the top middle module 28*a* is preferably a laser module including a red dot laser sight. Windage and elevation adjustments 30 are provided on the outside of the laser module 28*a*. The other modules 28 may preferably comprise a plurality of electronic accessories that would normally be mounted onto the weapon as separate components. The accessory modules 28 may include visible or infrared lighting devices such as a flashlight, a light emitting diode (LED) flashlight. These light elements can be configured to emit visible white light, colored light and/or infrared. Further, the light may be configured to operate in any number of modes including but not limited to continuous on, momentary on, high power, low power, strobe, etc. Further, the optical accessory module 28 may include laser devices positioned therein such as a red dot laser sight 28*a* as described above and commonly deployed on many weapons, an infrared laser for night vision targeting, a range finder device, a taser and/or a compact video camera depending on the needs of the combat mission. Each of the accessory modules 28 is fully interchangeable and in the event that some electronics modules are not needed the unnecessary module can be removed.

At FIG. 5, it can be seen that the accessory mounting platform 18 includes a power source to provide integrated power for the modules 28 installed thereon. An internal power source compartment 32 is provided and preferably contains batteries 34 therein. The accessory mounting platform 18 may include another power source compartment 32 on the opposing side thereof. In this configuration, two batteries 34 are preferably received on each side of the housing 20. The batteries 34 are enclosed by hinged doors 36 with spring loaded latching elements.

A connector port 38 is shown at the rear of the housing 20. The connector port 38 may serve many different functions. Preferably the connector port 38 allows the accessory mounting platform 18 to be interfaces with an external switching arrangement mounted on the sidewall of the modular handguard of the weapon. The switch bus includes a connector port at the front end, which is coupled to the mating connector port 38 on the rear of the housing 20. Alternately, the power source may be positioned in a location external to the accessory mounting platform 18 and interfaced with the accessory mounting platform 18 via the connector port 38. Still further a switch arrangement may be provided on the housing 20 of the accessory mounting platform 18 itself. In any regard the switch arrangement is operable for controlling the various combinations of accessory modules 28 that are mounted to the accessory mounting platform 18. Any switch arrangement provided is configured to allow the user to selectively operate one or all of the accessory modules 28 individually or in combination with one another as required.

Figure 6:
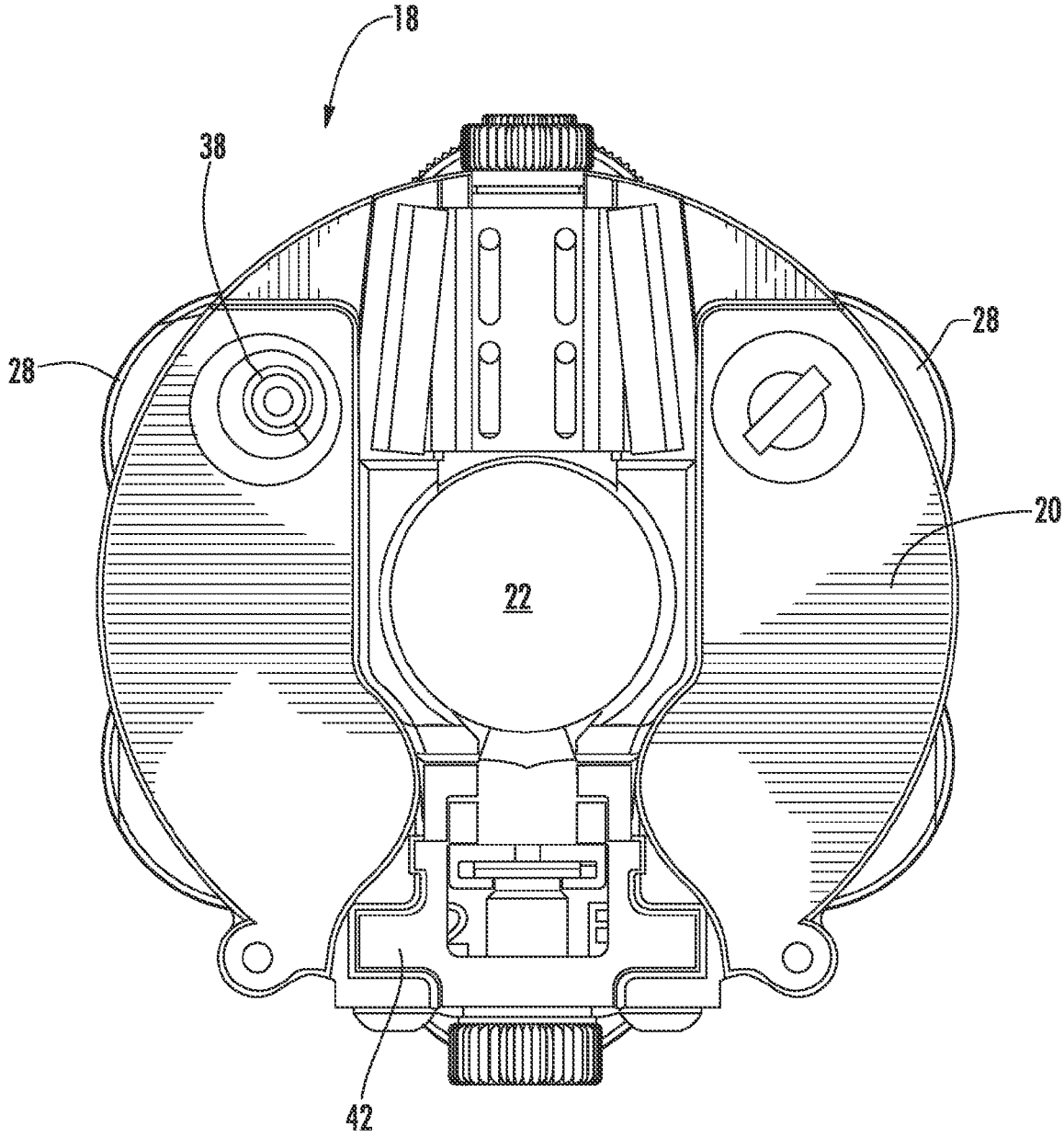
FIG. 6 is a rear view of the accessory mounting platform of the present invention.
Figure 7:
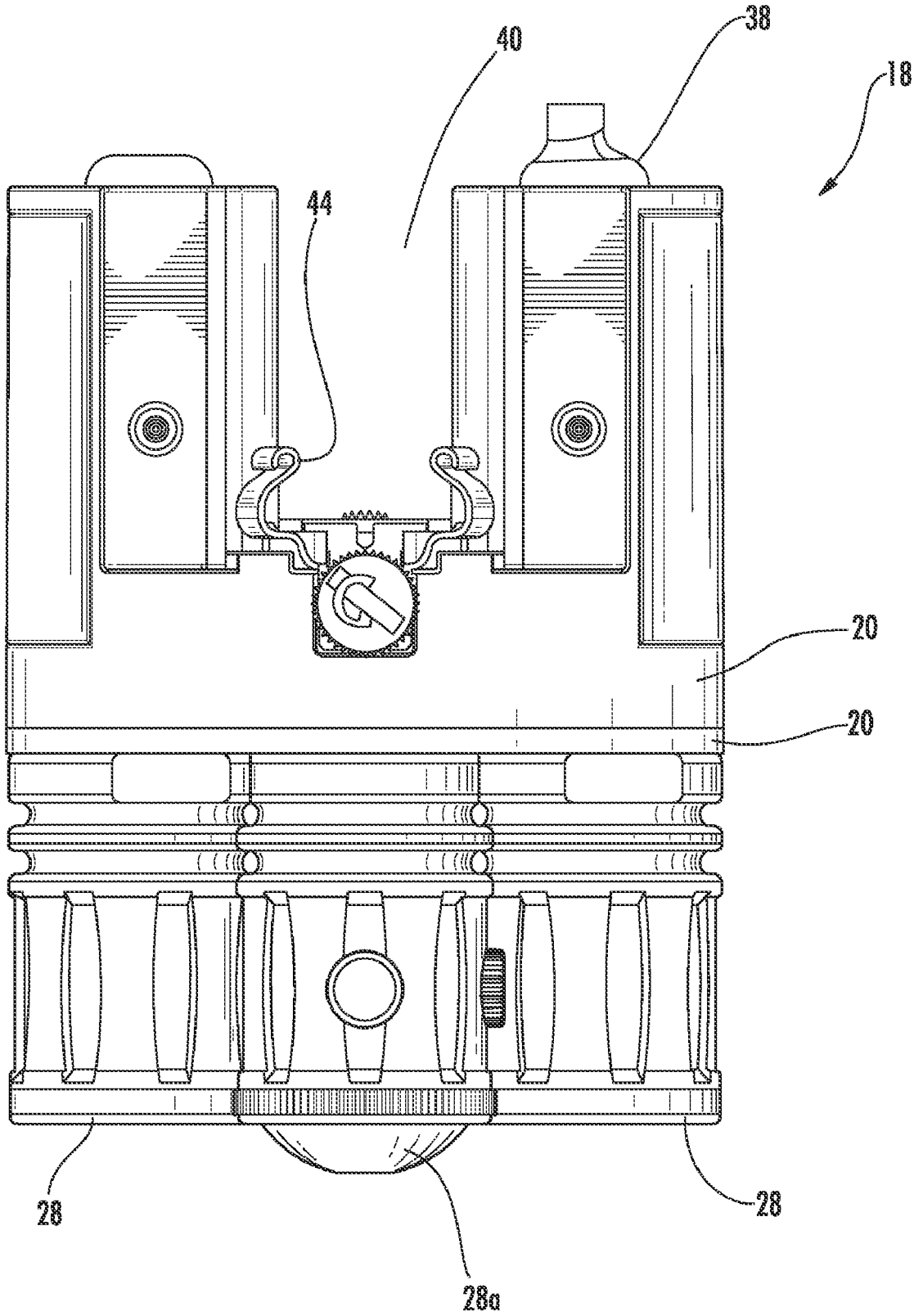
FIG. 7 is a top view of the accessory mounting platform of the present invention.
Figure 8:
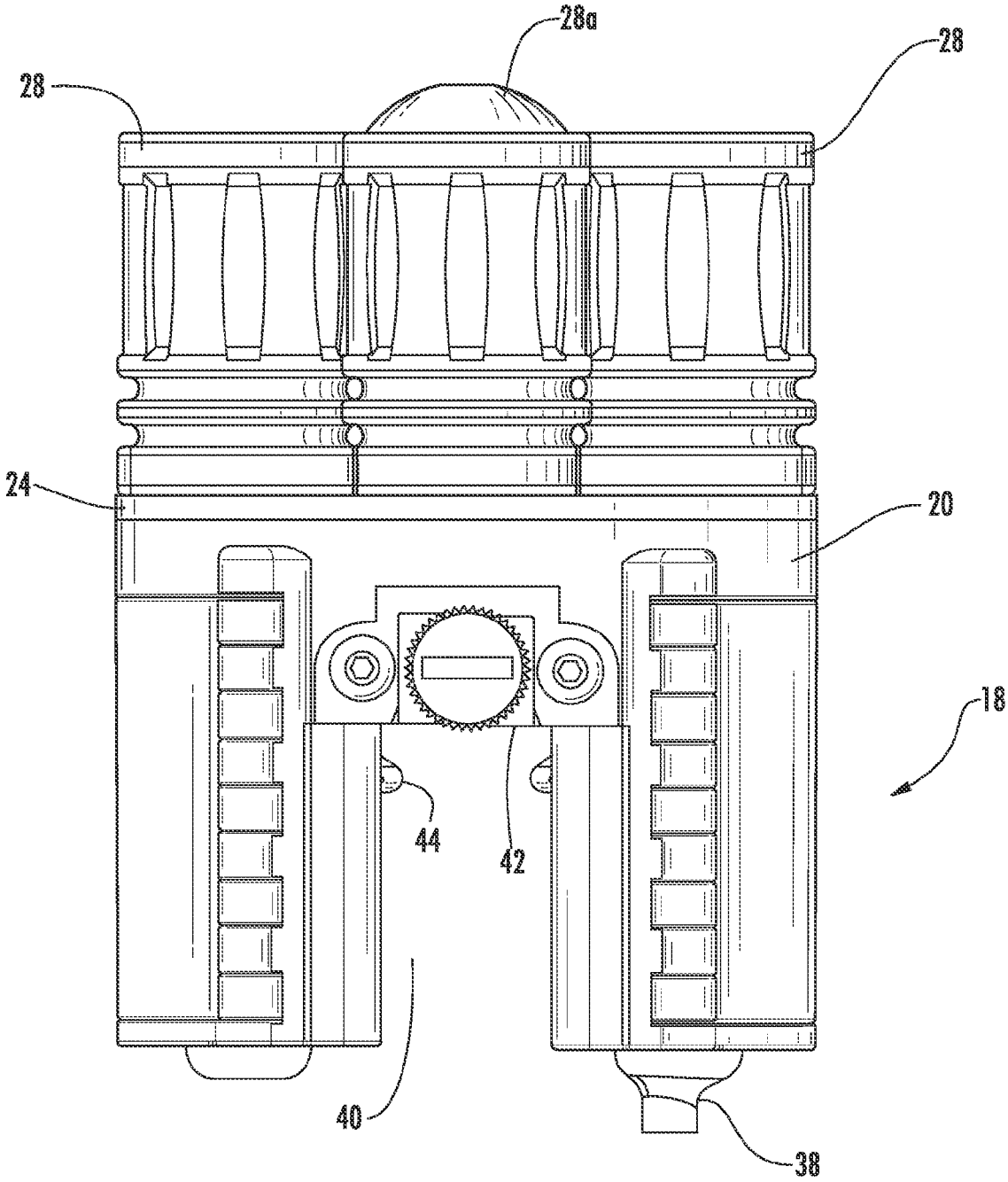
FIG. 8 is a bottom view of the accessory mounting platform of the present invention.

Turning now to FIGS. 6, 7 and 8, the accessory mounting platform 18 is preferably mounted to the bayonet lug 14 of the weapon and more preferably to the bayonet lug 14 and the front upright leg of the front weapon sight 12. The rear of the accessory mounting platform 18 housing 20 includes a channel 40 that wraps around the outside surfaces of the front sight 12 when the accessory mounting platform is received in assembled relation with the firearm. The lower portion of the channel 40 is provided with a bayonet lug clamp 42, while the top portion of the channel 40 is provided with a steel spring clip 44.

Figure 9:
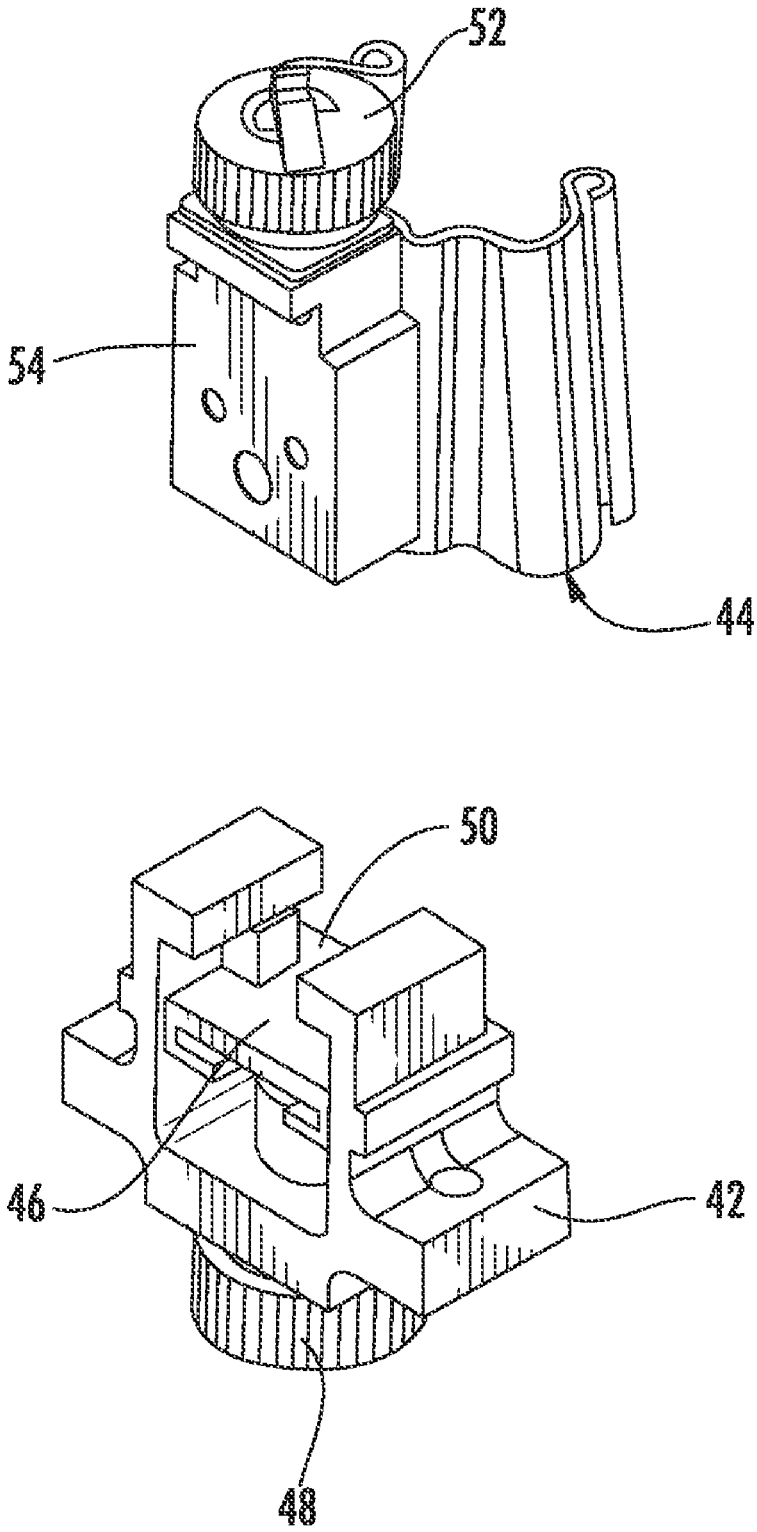
FIG. 9 is a perspective view of the lug clamp and sight clamp for retaining the mounting platform on a firearm.
Figure 10:
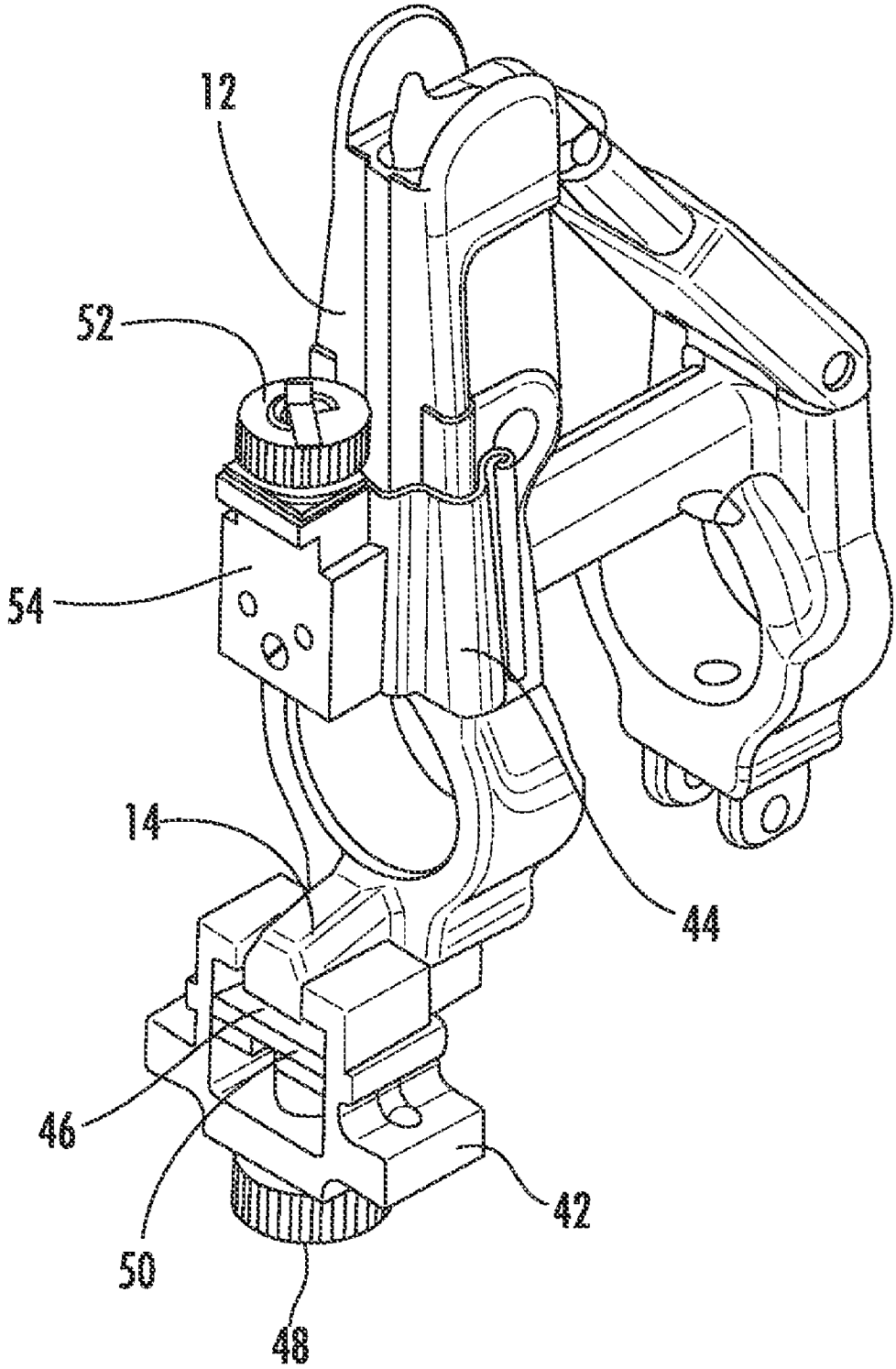
FIG. 10 is a perspective view of the lug clamp and sight clamp received about the bayonet lug and front sight of a firearm.

Focusing now on FIGS. 9 and 10, the lug clamp 42 and the spring clip 44 and their relationship with the front sight 12 and bayonet lug 14 are shown in detail with the remainder of the accessory mounting platform 18 removed. The accessory mounting platform 18 is slidably received over the barrel until the bayonet lug 14 is seated into the opening in the bayonet lug clamp 42. The bayonet lug 14 sits inside a guide portion 46 of the clamp 42. The lug clamp 42 includes a threaded thumbscrew 48 attached to a movable clamp element 50. Rotation of the thumbscrew 48 drives the clamp element 50 against the bottom of the bayonet lug 14 and captures the bayonet lug 14 between the upper legs of the guide portion 46 and the clamp element 50. The front sight clip 44 is secured to a clip block with pins. The pins pass through slots in the clip 44 in a manner that allows upward and downward movement of the clip 44 so that it will seat down onto the triangular outer surface of the front sight 12. The clip 44 is movable up and down along the mounting pins by an upper thumbscrew 52, which is threadably mounted in the clip block 54. Although the present embodiment shows a mounting configuration focused on the bayonet lug 14 of the weapon, there are other possibilities for securing the housing of the accessory mounting platform to the barrel or to the forward portion of the modular hand guard any such securement means are intended to be within the scope of the present disclosure.

Figure 11:
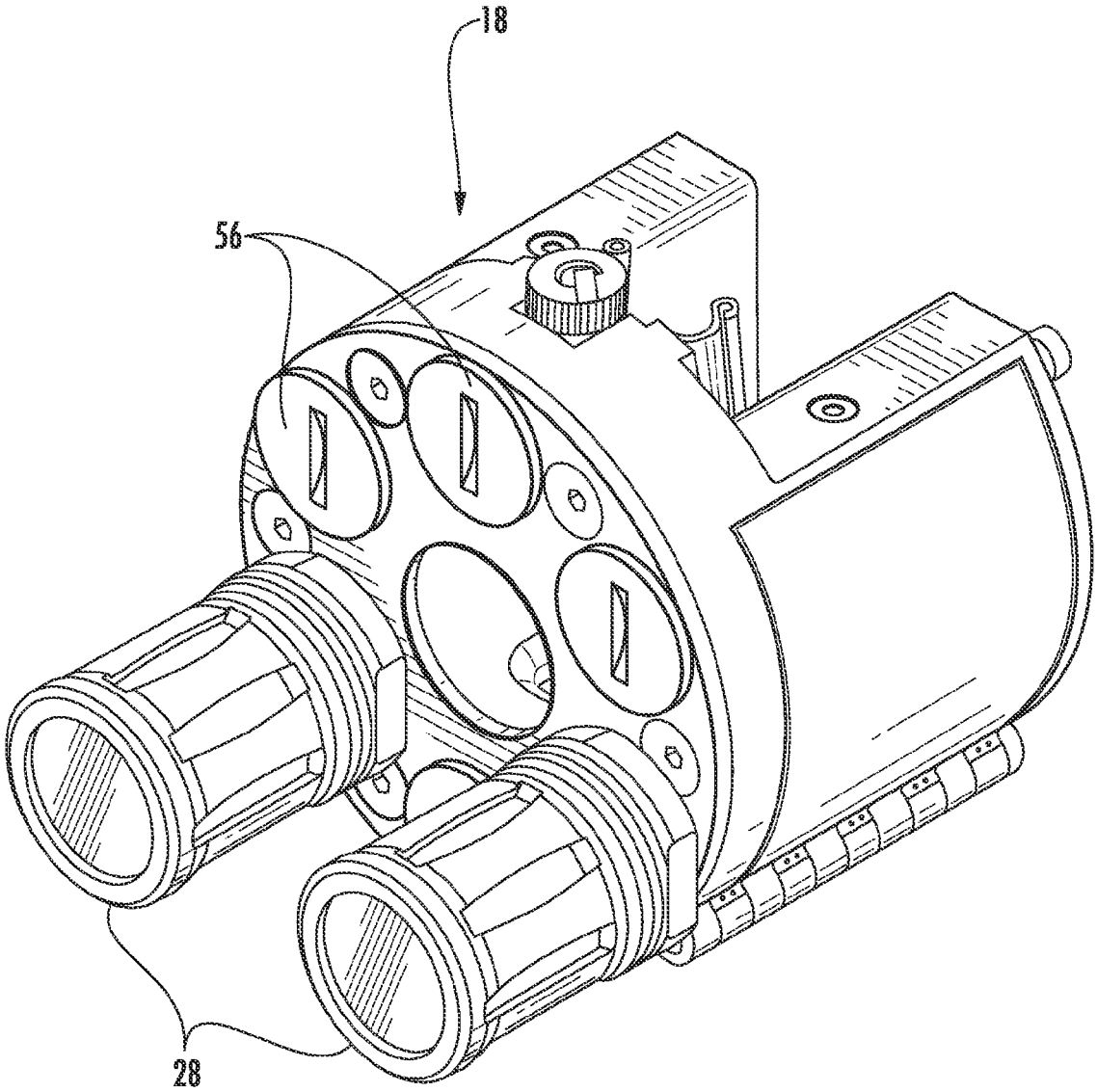
FIG. 11 depicts an alternate arrangement of the accessory modules.
Figure 12:
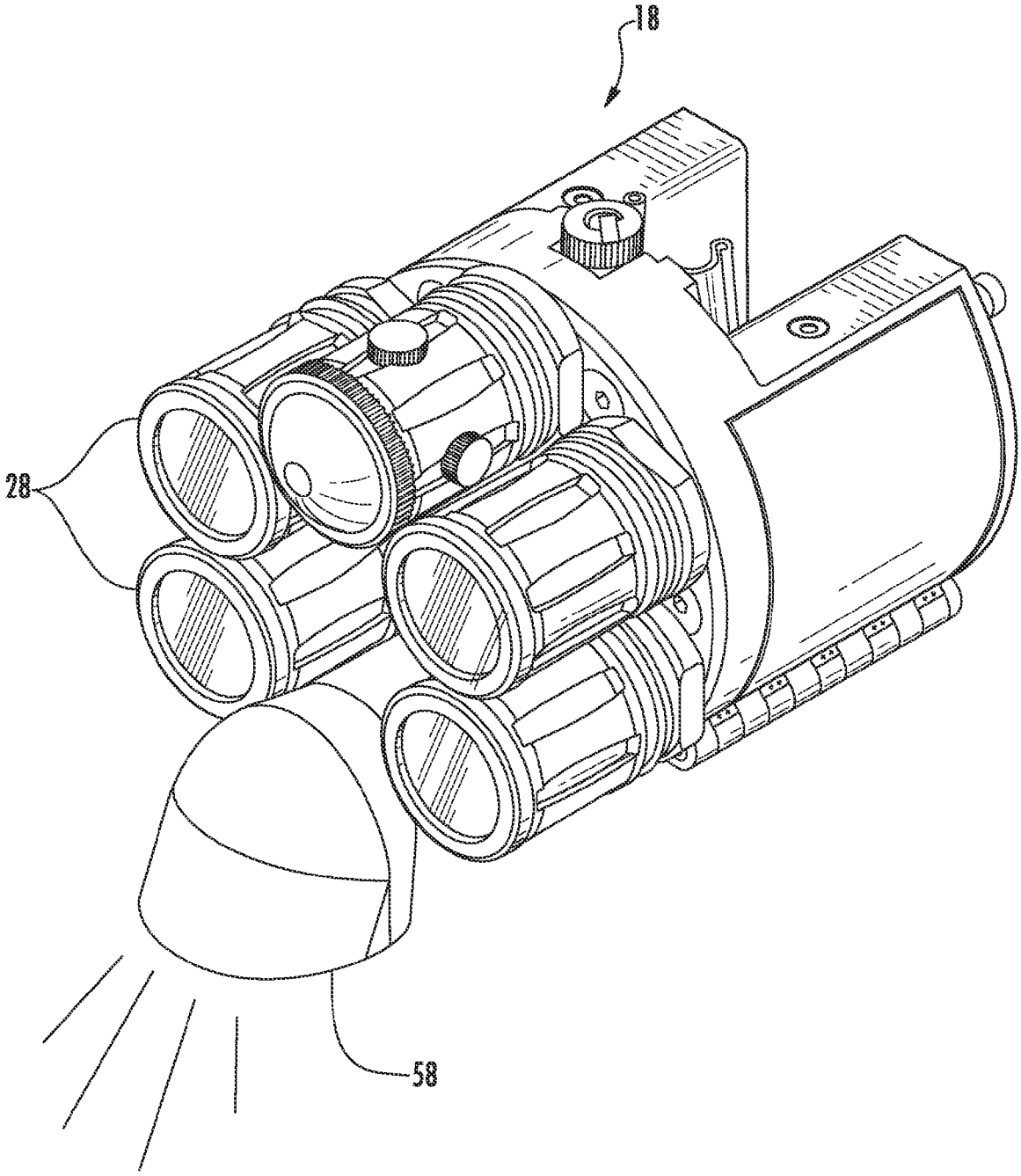
FIG. 12 depicts an alternate accessory module.

FIG. 11 shows an alternate configuration of accessory modules 28 mounted to the accessory platform 18. Plugs 56 are inserted into the open sockets when accessory modules 28 are not installed therein. FIG. 12 shows a reflector cup 58 mounted over the bottom middle light accessory module 28 to reflect light downwardly onto the ground in front of the soldier. Therefore, it can be seen that the present invention provides a unique accessory platform that is highly customizable to various combat situation.

It is important to note that the inventive concept taught within the context of the present invention is generally the provision of an accessory mounting platform that has an annular body that allows it to be received about the forward end of the firearm barrel and is configured to conform to engage the bayonet lug and/or the front sight of the weapon. In this context, the integration of the various electronic components can take on many configurations as desired by the end users. Optimal configurations will be developed according to market desired and practical needs.

Therefore, it can be seen that the present invention provides an accessory mounting platform that facilitates the integration of several different accessories into a single forward position about the barrel of the firearm in a manner that reduces the amount of space required for mounting them onto the weapon. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An accessory mounting platform for use on a firearm including a barrel, a bayonet lug and a forward sight, comprising:

an annular housing having a front surface, a rear surface, an aperture extending through said housing between said front and rear surfaces said aperture in said mounting platform capable of being received about said barrel;

an integrated power source;

a switch arrangement;

a plurality of sockets formed in said front surface; and at least one accessory releasably secured in one of said plurality of sockets, said accessory in electrical communication with said power source and selectively controlled via said switch arrangement;

wherein said rear surface of said mounting platform includes a clamping mechanism to engage said bayonet lug.

2. The accessory mounting platform of claim 1, said rear surface including a channel therein configured and arranged to be received about said forward sight and said clamping mechanism positioned therein to engage said bayonet lug.

3. The accessory mounting platform of claim 1, said rear surface including a channel therein configured and arranged to be received about said forward sight and including a clamping mechanism therein to engage said forward sight.

4. The accessory mounting platform of claim 1, said rear surface including a channel therein configured and arranged to be received about said forward sight said clamping mechanism positioned therein to engage said bayonet lug and a second clamping mechanism positioned therein to engage said forward sight.

5. The accessory mounting platform of claim 1, further comprising:

a connector port for interfacing with an external power source and switch arrangement.

6. The accessory mounting platform of claim 1, wherein said at least one accessory device is selected from the group consisting of: visible lights, infrared illuminators, lasers, range finders, accessory weapons, tasers and video cameras.

7. The accessory mounting platform of claim 1, wherein said at least one accessory further comprises:

at least two accessories positioned in at least two of said sockets.

8. The accessory mounting platform of claim 7, wherein said at least two accessory devices are selected from the group consisting of: visible lights, infrared illuminators, lasers, range finders, accessory weapons, tasers and video cameras.

9. The accessory mounting platform of claim 7, wherein the at least two accessory devices are the same.

10. The accessory mounting platform of claim 7, wherein the at least two accessory devices are different from one another.

* * * * *